US009961730B2

(12) United States Patent
Yu

(10) Patent No.: US 9,961,730 B2
(45) Date of Patent: May 1, 2018

(54) CIRCUIT OF LIGHT-EMITTING ELEMENTS

(71) Applicant: AmTRAN Technology Co., Ltd., New Taipei (TW)

(72) Inventor: Hung-Ta Yu, New Taipei (TW)

(73) Assignee: Amtran Technology Co., Ltd., New Taipei (TW)

( * ) Notice: Subject to any disclaimer, the term of this patent is extended or adjusted under 35 U.S.C. 154(b) by 525 days.

(21) Appl. No.: 14/617,229

(22) Filed: Feb. 9, 2015

(65) Prior Publication Data

US 2016/0025312 A1 Jan. 28, 2016

(30) Foreign Application Priority Data

Jul. 22, 2014 (TW) ..... 103125122 A

(51) Int. Cl.
*G09G 3/32* (2016.01)
*H05B 33/08* (2006.01)
*G09G 3/34* (2006.01)

(52) U.S. Cl.
CPC ..... *H05B 33/0821* (2013.01); *G09G 3/3406* (2013.01)

(58) Field of Classification Search
CPC ..... G09G 3/3406; G09G 3/3283; G09G 2300/0852; H05B 33/0821; H05B 33/0827; H05B 33/0896; G03G 15/5016; Y02B 20/36
See application file for complete search history.

(56) References Cited

U.S. PATENT DOCUMENTS 7,323,720 B2 * 1/2008 Kubota ..... G03G 15/5016 257/291
7,499,141 B2 * 3/2009 Lai ..... G02F 1/1345 257/59
7,884,978 B2 * 2/2011 Ikeno ..... H04N 1/02815 358/475
8,064,029 B2 * 11/2011 Park ..... G02F 1/1345 349/152
8,363,294 B2 * 1/2013 Kim ..... H04N 1/401 358/1.16
2009/0251675 A1 * 10/2009 Masumoto ..... B41J 2/45 355/69

(Continued)

*Primary Examiner* — Alexander H Taningco
*Assistant Examiner* — Kurtis R Bahr
(74) *Attorney, Agent, or Firm* — Muncy, Geissler, Olds & Lowe, P.C.

(57) ABSTRACT

A circuit of light-emitting elements connected between two power terminals is disclosed in the present disclosure. The circuit of light-emitting elements includes a smooth conducting line, multiple light-emitting elements, and a zigzag conducting line. The smooth conducting line is connected to one of the power terminals. One terminal of each light-emitting element is electrically connected at a different position of the smooth conducting line. The zigzag conducting line is connected to the other of the power terminals, and the other terminal of each light-emitting element is electrically connected at a different position of the zigzag conducting line. Each shortest path, starting from one of the power terminals, passing through any the light-emitting element along the smooth conducting line, and ending at the other of the power terminals along the zigzag conducting line, has substantially a same resistance value.

6 Claims, 7 Drawing Sheets

(56) References Cited

U.S. PATENT DOCUMENTS

2014/0054628 A1* 2/2014 Sugiura ..... H01L 25/0753
257/91
2015/0317951 A1* 11/2015 Genoe ..... G09G 3/3283
345/212

* cited by examiner

CIRCUIT OF LIGHT-EMITTING ELEMENTS

RELATED APPLICATIONS

This application claims priority to Taiwanese Application Serial Number 103125122, filed Jul. 22, 2014, which is herein incorporated by reference.

BACKGROUND

Field of Invention

The present disclosure relates to a circuit of light-emitting elements. More particularly, the present disclosure relates to a circuit in which light-emitting elements share a zigzag conducting line configured to be electrically connected to a power terminal.

Description of Related Art

In recent years, display devices have become one of the indispensable components of electronic products. In addition, owing to the exponential growth of network transmission rate and high coding efficiency of video compression technology, consumers have increasing demands for display quality.

Generally speaking, a backlight module of a display device usually enhances contrast ratio of the display device by light dimming. In greater detail, when the display device displays a dark picture (such as a night scene), the luminance of the backlight module is reduced. When the display device displays a bright picture (such as a sunny day), the luminance of the backlight module is increased. However, since the brightness across the picture is not constant, the backlight module performs a local dimming operation so as to satisfy the desired brightness at all pixels constituting the picture, thus improving contrast ratio of the display device.

Conventionally, in order to achieve local dimming, conducting states of light-emitting elements are controlled by adjusting a plurality of negative power terminals. FIG. 1 depicts a schematic diagram of a circuit of light-emitting elements 100. The circuit of light-emitting elements 100 comprises a plurality of light-emitting elements 101-106. First terminals of the light-emitting elements 101-106 are jointly in electrical connection with a positive power terminal. Second terminals of the light-emitting elements 101-106 are respectively in electrical connection with different negative power terminals. With respect to the driving method, the positive power terminal is maintained at a high voltage level, and local dimming function is implemented through adjusting voltage levels at the negative power terminals.

Although aforementioned method can achieve the objective of local dimming, paths starting from the positive power terminal, passing through each of the light-emitting elements 101-106, and ending at corresponding negative power terminals do not have identical length, given that a viewpoint following the current flow is taken into account. Moreover, the conducting line itself has a specific resistance value, that is, $R=\rho(L/A)$, wherein R is the resistance value of the conducting line, L is the length of the conducting line, A is the cross-sectional area of the conducting line, and $\rho$ is the resistivity of the conducting line. The magnitude of the resistivity $\rho$ relates to the material property of the conducting line itself. Hence, the resistance values of paths passing through each of the light-emitting elements 101-106 are different. As a result, under the same driving voltage, the light-emitting intensities of the light-emitting element 101-106 differ from each other. For example, since the path in which the current flows through the light-emitting element 101 is much longer than the path in which the current flows through the light-emitting element 106, the luminance of the light-emitting element 101 is lower than the luminance of the light-emitting element 106, which makes the local dimming method inefficiently raise the contrast ratio of the display device. In addition, adjusting voltage levels at the plurality of negative power terminals also increases design complexity and power consumption of the external driving circuit.

SUMMARY

To solve above difficulties, the present disclosure provides a circuit of light-emitting elements so that multiple light-emitting elements all exhibit the same luminance when local dimming is performed.

A circuit of light-emitting elements, electrically connected between two power terminals, is provided in one embodiment of the present disclosure. The circuit of light-emitting elements includes a smooth conducting line, multiple light-emitting elements, and a zigzag conducting line. The smooth conducting line is electrically connected to one of the power terminals. One terminal of each light-emitting element is electrically connected at a different position of the smooth conducting line. The zigzag conducting line is connected to the other of the power terminals. The other terminal of each light-emitting element is electrically connected at a different position of the zigzag conducting line. Each shortest path starting from the one of the power terminals, passing through any of the light-emitting elements along the smooth conducting line, and ending at the other of the power terminals along the zigzag conducting line has substantially a same resistance value.

A circuit of light-emitting elements, electrically connected between two power terminals, is provided in another embodiment of the present disclosure. The circuit of light-emitting elements includes multiple smooth conducting lines, multiple light-emitting element sets, and a zigzag conducting line. The smooth conducting lines are connected to one of the power terminals in sequence or simultaneously. Each light-emitting element set has a first light-emitting element and a second light-emitting element. The first light-emitting element and the second light-emitting element are electrically connected in parallel to the corresponding smooth conducting line. The zigzag conducting line is connected to the other of the power terminals. Each first or second light-emitting element is electrically connected at a different position of the zigzag conducting line. Each shortest path starting from one of the power terminals, passing through the corresponding first or second light-emitting element along any smooth conducting line, and ending at the other of the power terminals along the zigzag conducting line has substantially a same resistance value.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure. In the drawings.

DESCRIPTION OF THE EMBODIMENTS

Various embodiments are described more fully below with reference to the accompanying drawings, which form a part hereof, and which show embodiments for practicing the disclosure. However, embodiments may be implemented in many different forms and should not be construed as limited to the embodiments set forth herein; rather, these embodiments are provided so that this disclosure will be thorough and complete, and will fully convey the scope of the disclosure to those skilled in the art.

It will be understood that when an element is referred to as being "connected" to another element, it can be directly connected to the other element or intervening elements may be present. In contrast, when an element is referred to as being "directly connected" to another element, there are no intervening elements present.

As used herein, "substantially" shall generally mean within 20 percent, preferably within 10 percent, and more preferably within 5 percent of a given value or range. Numerical quantities given herein are approximate, meaning that the term "substantially" can be inferred if not expressly stated.

Figure 1:
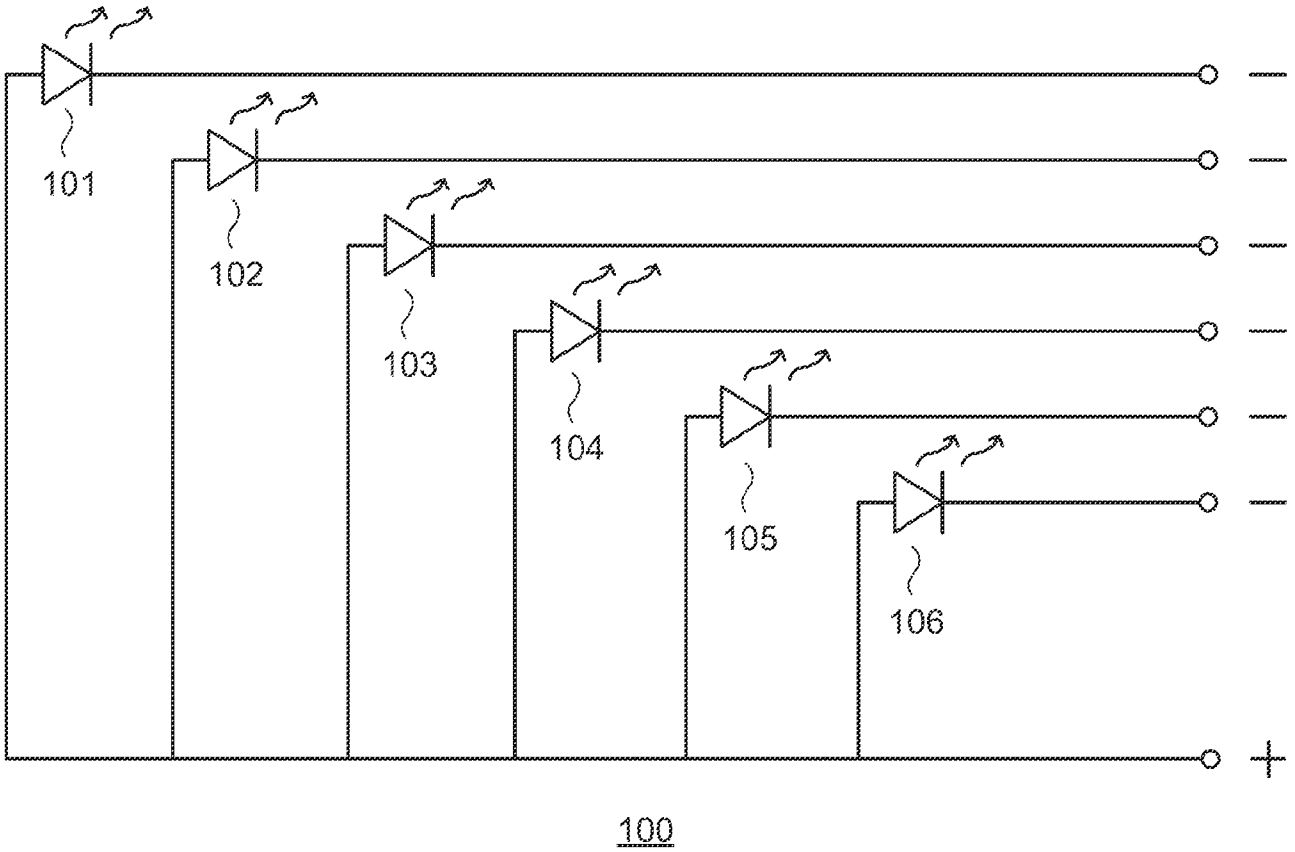
Fig. 1 ( PRIOR ART )
FIG. 1 depicts a schematic diagram of a circuit of light-emitting elements.
Figure 2:
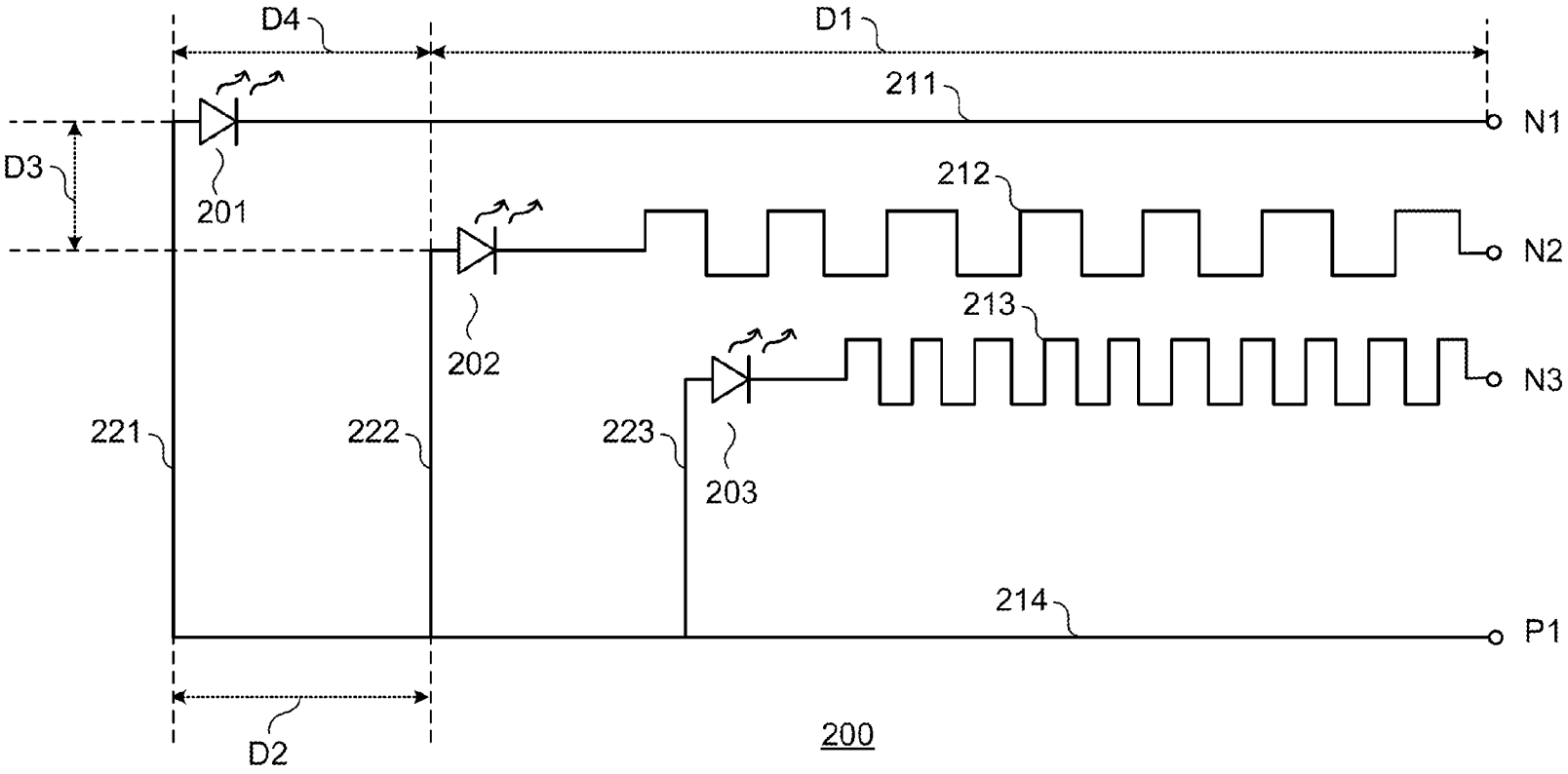
FIG. 2 depicts a schematic diagram of a circuit of light-emitting elements.

FIG. 2 depicts a schematic diagram of a circuit of light-emitting elements 200. The circuit of light-emitting elements 200 is electrically connected between a power terminal P1 and a plurality of power terminals N1-N3. The circuit 200 comprises a plurality of light-emitting elements 201-203, a smooth conducting line 211, a zigzag conducting line 212, a zigzag conducting line 213, a smooth conducting line 214, and plurality of first connecting line segments 221-223. The power terminal P1 and the plurality of power terminals N1-N3 are controlled by an external driving circuit (not shown in the figure). Each of the light-emitting elements 201-203 comprises a first terminal and a second terminal.

The first terminal of the light-emitting element 201 is electrically connected to the smooth conducting line 214 via the first connecting line segment 221, and the second terminal is electrically connected to the smooth conducting line 211.

The first terminal of the light-emitting element 202 is electrically connected to the smooth conducting line 214 via the first connecting line segment 222, and the second terminal is electrically connected to the zigzag conducting line 212.

The first terminal of the light-emitting element 203 is electrically connected to the smooth conducting line 214 via the first connecting line segment 223, and the second terminal is electrically connected to the zigzag conducting line 213.

In the present embodiment, the power terminal P1 is maintained at a high voltage. The power terminals N1-N3 are configured for receiving different control voltages to control the conducting states of the light-emitting elements 201-203 (that is, whether the light-emitting elements 201-203 emit light or not) so as to allow the circuit 200 achieve the objective of local dimming. For example, if it is intended to turn on the light-emitting element 202 and turn off the light-emitting elements 201, 203, what is needed is to simply set the voltage at the terminal N2 to a low level and the voltages at the terminals N1 and N3 to a high level. Then, the light-emitting element 202 will emit light alone.

The zigzag conducting lines 212, 213 are respectively configured for adjusting shortest path lengths of currents flowing through the light-emitting elements 202, 203 so that shortest paths respectively corresponding to the light-emitting elements 201-203 have substantially the same length. In greater detail, take the light-emitting elements 201, 202 for example, and the light-emitting elements 201, 202 are regarded as conducting lines. A difference between a length of the zigzag conducting line 212 and a partial length D1 of the smooth conducting line 211 is used for compensating a partial length D2 of the smooth conducting line 214, a partial length D3 of the first connecting line segment 221, and a partial length D4 of the smooth conducting line 211, which allows the shortest paths of currents flowing through the light-emitting elements 201, 202 have substantially the same length. That is, magnitudes of resistance values of paths respectively from the power terminal P1 to the power terminals N1, N2 are substantially identical. Similarly, the zigzag conducting line 213 corresponding to the light-emitting element 203 is also configured for compensating path differences resulting from a distinct position of the light-emitting element 203 relative to the light-emitting elements 201, 202.

Hence, the shortest paths respectively starting from the power terminal P1, passing through the light-emitting elements 201-203, and ending at the corresponding power terminals N1-N3 have substantially the same length; that is, the shortest paths have substantially the same resistance value.

However, if the light-emitting elements 201-203 emit light simultaneously, adjustment of the voltages at the power terminals N1-N3 electrically connected to the circuit 200 may still slightly increase design complexity and power consumption of the external driving circuit, although the light-emitting elements 201-203 are able to exhibit the same luminance. In addition, the circuit of light-emitting elements 200 is usually fabricated as a slim light bar when the circuit 200 is applied to an edge-lit light emitting diode (LED) backlight of a liquid crystal display. It is not easy to lay out and dispose within the narrow light bar width a plurality of zigzag conducting lines that occupy more width. If the number of the light-emitting elements is increased, the number of zigzag conducting lines needs to be increased accordingly. As a result, the light bar width needs to be enlarged, which contradicts the trend of thinning backlight modules.

Figure 3:
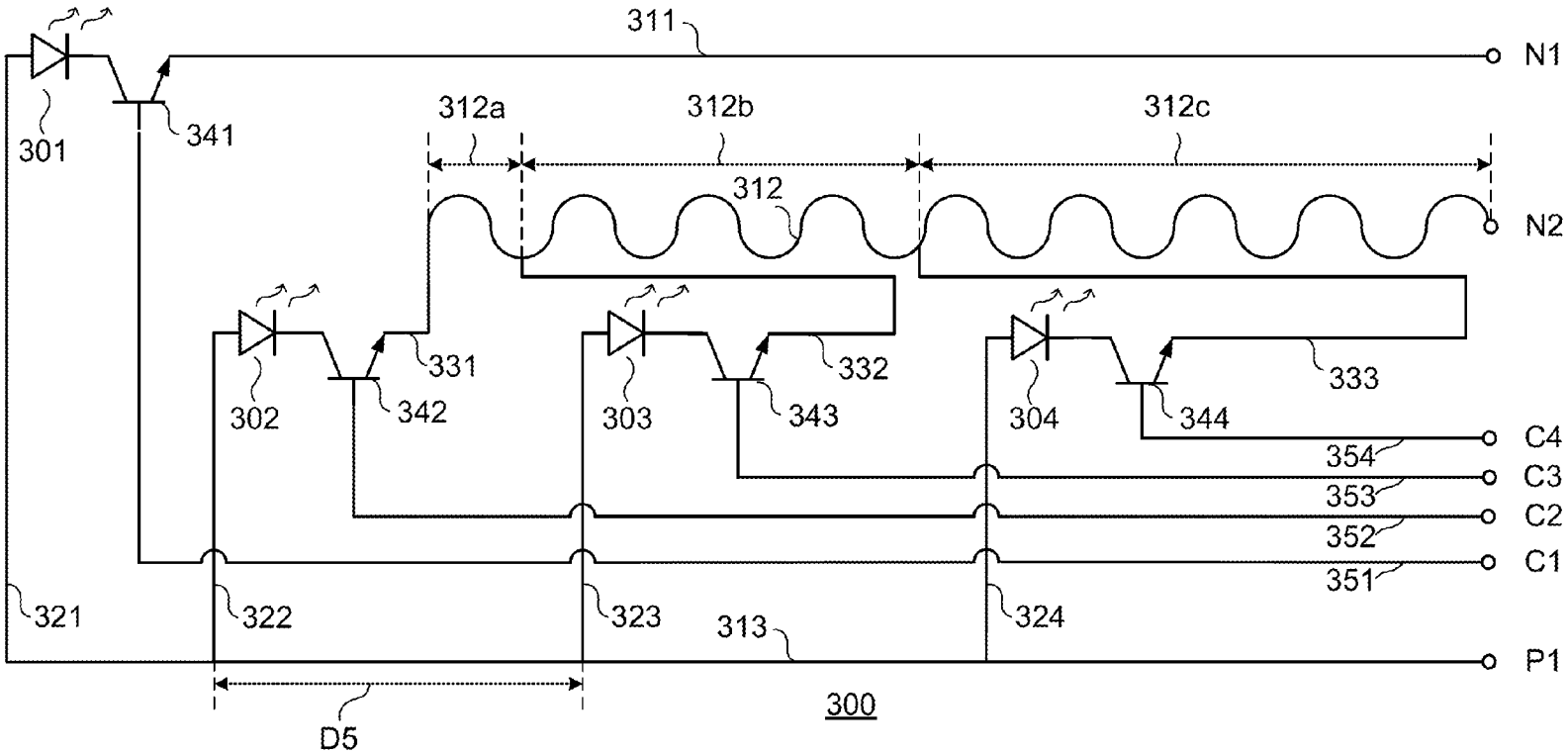
FIG. 3 depicts a schematic diagram of a circuit of light-emitting elements according to one embodiment of this disclosure.

In order to resolve the above-mentioned problem, a description is provided with reference to FIG. 3. FIG. 3 depicts a schematic diagram of a circuit of light-emitting elements 300 according to one embodiment of this disclosure. The circuit 300 is electrically connected between the power terminal P1 and the plurality of power terminals N1, N2. The circuit 300 comprises a plurality of light-emitting elements 301-304, a smooth conducting line 311, a zigzag conducting line 312, a smooth conducting line 313, a plurality of first connecting line segments 321-324, a plurality of second connecting line segments 331-333, a plurality of switching elements 341-344, and a plurality of control lines 351-354. Each of the light-emitting elements 301-304 comprises a first terminal and a second terminal. Each of the switching elements 341-344 comprises a first terminal, a second terminal, and a control terminal. The zigzag conducting line 312 comprises a plurality of zigzag segments 312*a*-312*c*.

The first terminals of the light-emitting elements 301-304 are electrically connected at different positions of the smooth conducting line 313 respectively via the first connecting line segments 321-324. The second terminal of the light-emitting element 301 is electrically connected to the smooth conducting line 311. The second terminals of the light-emitting elements 302-304 are electrically connected at different positions of the zigzag conducting line 312.

The zigzag conducting line 312 comprises the plurality of zigzag segments 312*a*-312*c* connected in series. Each of the zigzag segments 312*a*-312*c* comprises a starting end.

The switching element 341 is electrically connected between the light-emitting element 301 and the smooth conducting line 311. The switching elements 342-344 are electrically connected respectively between the light-emitting elements 302-304 and the different positions of the zigzag conducting line 312. Specifically, the first terminals of the switching elements 341-344 are respectively in electrical connection with the second terminals of the light-emitting elements 301-304. The control terminals of the switching elements 341-344 are respectively in electrical connection with the control lines 351-354. The second terminal of the switching element 341 is electrically connected to the smooth conducting line 311. The second terminals of the switching elements 342-344 are electrically connected the starting ends of the zigzag segments 312*a*-312*c* respectively via the second connecting line segments 331-333. In other words, the switching elements 342-344 are electrically connected between the second connecting line segments 331-333 and the light-emitting elements 302-304.

In some embodiments, the switching elements 342-344 may be electrically connected between the smooth conducting line 313 and the light-emitting elements 302-304. More specifically, the switching elements 342-344 are electrically connected between the first connecting line segments 322-324 and the light-emitting elements 302-304.

In some embodiments, the first connecting line segments 322-324 have a same resistance value, and the second connecting line segments 331-333 have different resistance values.

It is worth to notice that the zigzag conducting line 312 and the second connecting line segments 331-333 are configured for adjusting the shortest path lengths of currents flowing through the light-emitting elements 302-304 so that the shortest paths respectively corresponding to the light-emitting elements 301-304 have substantially the same length. In greater detail, take the light-emitting elements 302, 303 for example, if lengths of the first connecting line segments 321-324 are the same, a length of the second connecting line segment 332 is set to be a sum of a length of the zigzag segment 312*a*, a length of the second connecting line segment 331 and a partial length D5 of the smooth conducting line 313 so as to allow the shortest path lengths of currents flowing through the light-emitting elements 302, 303 are substantially the same. That is, magnitudes of resistance values of paths respectively from the power terminal P1, through the light-emitting elements 302, 303, to the power terminal N2 are substantially the same. Similarly, the second connecting line segments 333 corresponding to the light-emitting element 304 is also used for compensating path differences resulting from a distinct position of the light-emitting element 304 relative to positions of the light-emitting elements 302, 303.

Hence, the shortest paths starting from the power terminal P1, respectively passing through the light-emitting elements 301-304, and ending at the corresponding power terminals N1-N2 have substantially the same length, that is, have substantially the same resistance value. The shortest path corresponding to the light-emitting element 301 comprises the smooth conducting line 313, the first connecting line segment 321, the light-emitting element 301, the switching element 341, and the smooth conducting line 311. The shortest path corresponding to the light-emitting element 302 comprises part of the smooth conducting line 313, the first connecting line segment 322, the light-emitting element 302, the switching element 342, the second connecting line segment 331, and the zigzag conducting line 312. The shortest path corresponding to the light-emitting element 303 comprises part of the smooth conducting line 313, the first connecting line segment 323, the light-emitting element 303, the switching element 343, the second connecting line segment 332, and part of the zigzag conducting line 312 (the zigzag segment 312*b* and the zigzag segment 312*c*). The shortest path corresponding to the light-emitting element 304 comprises part of the smooth conducting line 313, the first connecting line segment 324, the light-emitting element 304, the switching element 344, the second connecting line segment 333, and part of the zigzag conducting line 312 (the zigzag segment 312*c*).

The control lines 351-354 are configured for receiving control signals C1-C4 transmitted from an external driving circuit (not shown in the figure) to allow the switching elements 341-344 to determine turning-on/off of the light-emitting elements 301-304 according to the above-mentioned control signals C1-C4.

In the present embodiment, the power terminal P1 stays at a high voltage level, and the power terminals N1, N2 are kept at a low voltage level. If it is intended to turn on the light-emitting elements 301, 304, the external driving circuit (not shown in the figure) would control the control signals C1, C4 to have an enabling voltage and the control signals C2, C3 to have a disabling voltage. Thus, the light-emitting elements 301, 304 will emit light, and the objective of local dimming may be carried out. It should be noticed that when performing local dimming, the control signals C1-C4 in the embodiment are low voltage signals as compared with those (high voltage signals) at the terminals P1, P2 of the circuit 200 shown in FIG. 2. Using low voltage signals for controlling conducting states of the light-emitting elements 301-304 would effectively reduce power consumption and design complexity in the external driving circuit. Additionally, the light-emitting elements 302, 303, 304 in the embodiment share the same zigzag conducting line 312, which differs from the prior art adopting multiple zigzag conducting lines occupying larger widths. The embodiment can further lessen width of the light bar in the backlight module, achieving a result of thinning the backlight module.

In some embodiments, the zigzag segments 312*a*-312*c* may have different resistance values, different conducting line lengths, different conducting line widths, different conducting line densities, or different shapes.

Figure 4:
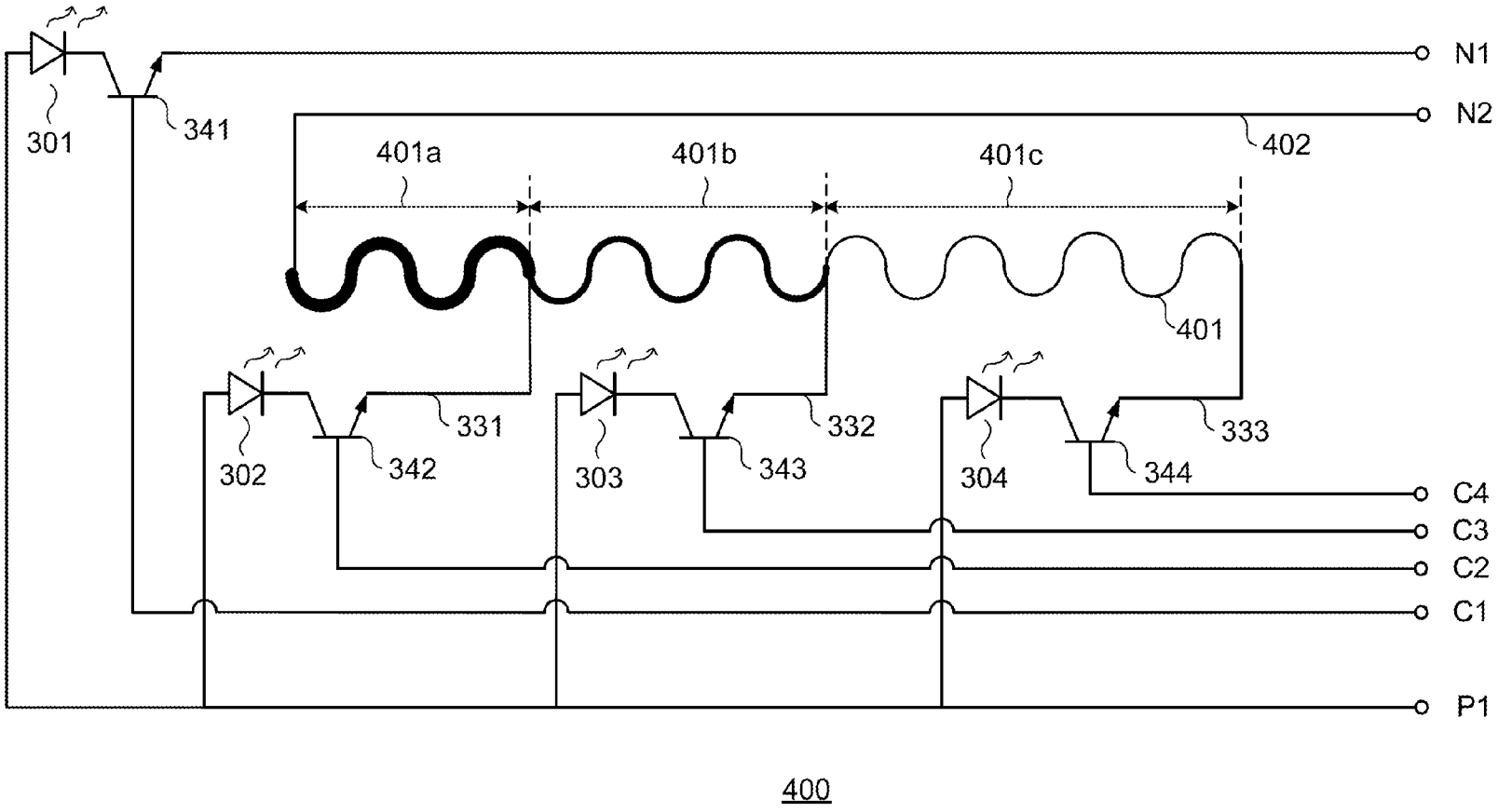
FIG. 4 depicts a schematic diagram of a circuit of light-emitting elements according to another embodiment of this disclosure.

Referring to FIG. 4. FIG. 4 depicts a schematic diagram of a circuit of light-emitting elements 400 according to another embodiment of this disclosure. As compared with the circuit of light-emitting elements 300 in FIG. 3 which comprises the zigzag conducting line 312, the circuit 400 according to the present embodiment comprises a zigzag conducting line 401 and a smooth conducting line 402. The zigzag conducting line 401 comprises zigzag segments 401*a*-401*c* connected in series. Each of the zigzag segments 401*a*-401*c* comprises a starting end.

The zigzag conducting line 401 is electrically connected to the power terminal N2 via the smooth conducting line 402. The starting end of the zigzag segment 401*a* electrically connects to the second connecting line segment 331. The starting end of the zigzag segment 401*b* electrically connects to the second connecting line segment 332. The starting end of the zigzag segment 401*c* electrically connects to the second connecting line segment 333. By adjusting line widths and lengths of the zigzag segments 401*a*-401*c* as well as lengths of the second connecting line segments 331-333, resistance values of shortest paths passing through the light-emitting elements 302-304 and a resistance value of a shortest path passing through the light-emitting element 301 are substantially the same.

In the embodiment, based on distances between the light-emitting elements 302-304 and the light-emitting element 301, distances between the light-emitting elements 301-304 and the power terminal P1, and distances between the light-emitting elements 301-304 and the power terminal N2, the order of conducting line widths of the zigzag segments 401*a*-401*c* from large to small is: the zigzag segment 401*a*, the zigzag segment 401*b*, and then the zigzag segment 401*c*. With such a configuration, the shortest paths respectively starting from the power terminal P1, passing through the light-emitting elements 301-304, and ending at the corresponding power terminals N1, N2 would have substantially the same resistance value. In the embodiment, width design of a conducting line may affect resistance value of the related path under a premise that the length of the conducting line is fixed. For example, adopting a wider conducting line can lower the resistance value per unit length of the conducting line. Likewise, adopting a narrower conducting line can augment the resistance value per unit length of the conducting line.

The switching elements 341-344 are configured for controlling conducting states of the light-emitting elements 301-304. The driving method of the circuit 400 is similar to that of the circuit 300 in FIG. 3.

Figure 5:
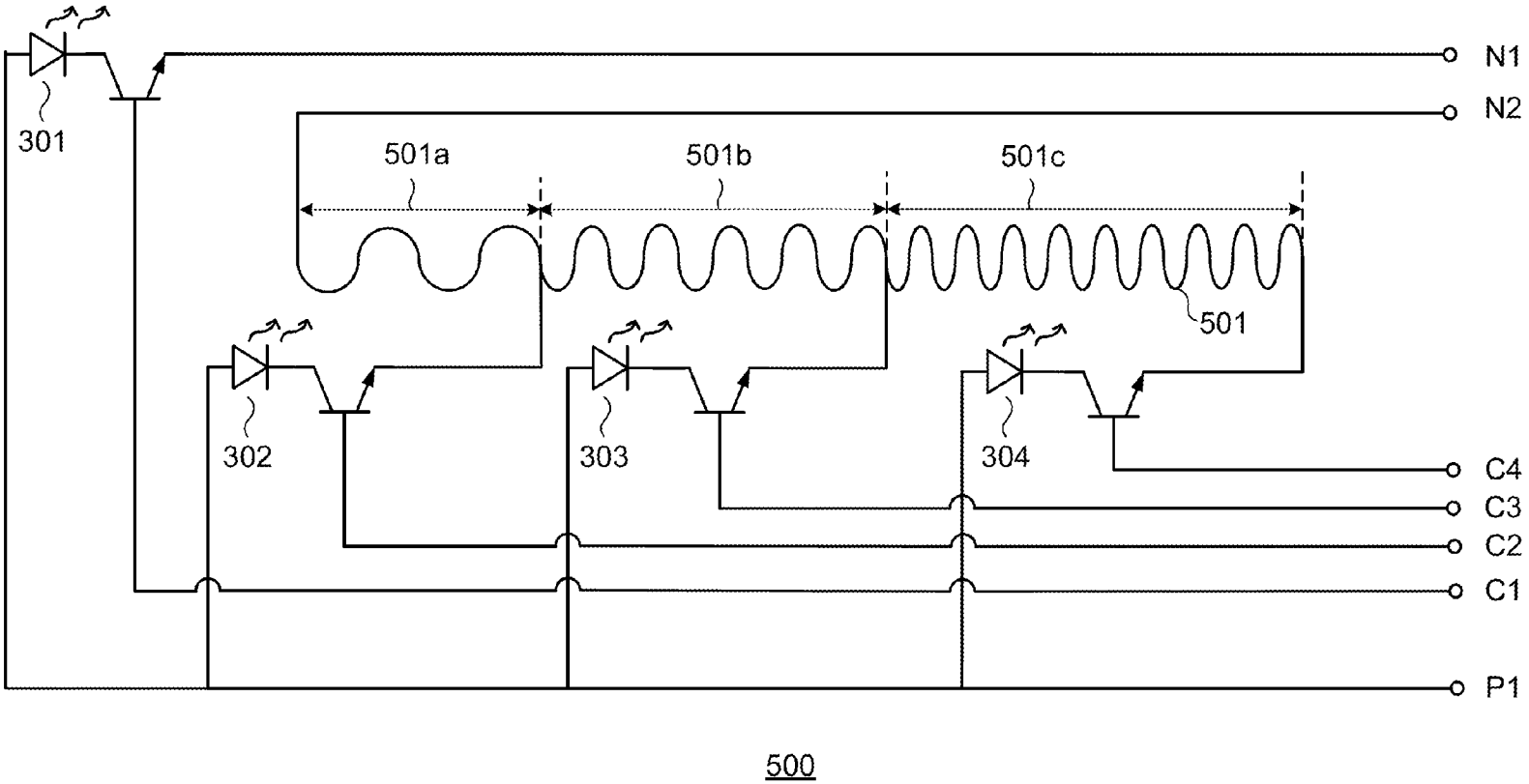
FIG. 5 depicts a schematic diagram of a circuit of light-emitting elements according to still another embodiment of this disclosure.

Referring to FIG. 5. FIG. 5 depicts a schematic diagram of a circuit of light-emitting elements 500 according to still another embodiment of this disclosure. As compared with FIG. 4, a plurality of zigzag segments 501*a*-501*b* of a zigzag conducting line 501 of the circuit 500 have similar conducting line widths but different conducting line densities. In the present embodiment, the zigzag conducting line 501 is a sinusoidal conducting line; the conducting line density of the zigzag conducting line 501 may thus be defined as the spatial frequency of the sinusoidal wave shown by the zigzag conducting line 501. Based on distances between the light-emitting elements 302-304 and the light-emitting element 301, distances between the light-emitting elements 301-304 and the power terminal P1, and distances between the light-emitting elements 301-304 and the power terminals N1, N2, the order of the conducting line densities of the zigzag segments 501*a*-501*c* from small to large is: the zigzag segment 501*a*, the zigzag segment 501*b*, and then the zigzag segment 501*c*.

As to the driving method, the driving method of the circuit 500 is similar to the driving method of the circuit 400 in FIG. 4.

As shown in FIG. 3 to FIG. 5, the proportion of the light-emitting elements to the switching elements in either of the circuits 300, 400, 500 is 1:1. In other words, it is necessary to supplement one switching element if an extra light-emitting element is added. In a small-sized display device, since only a few lighting segments have to be controlled, it is feasible to increase the number of the switching elements appropriately. In an embodiment of large-sized display device, based on the technique of utilizing the zigzag conducting line to balance resistance values in aforementioned embodiments, the present disclosure further provides extensive embodiments to lower the number of the switching elements needed for increasing lighting segments, and therefore further simplify wire connection.

Figure 6:
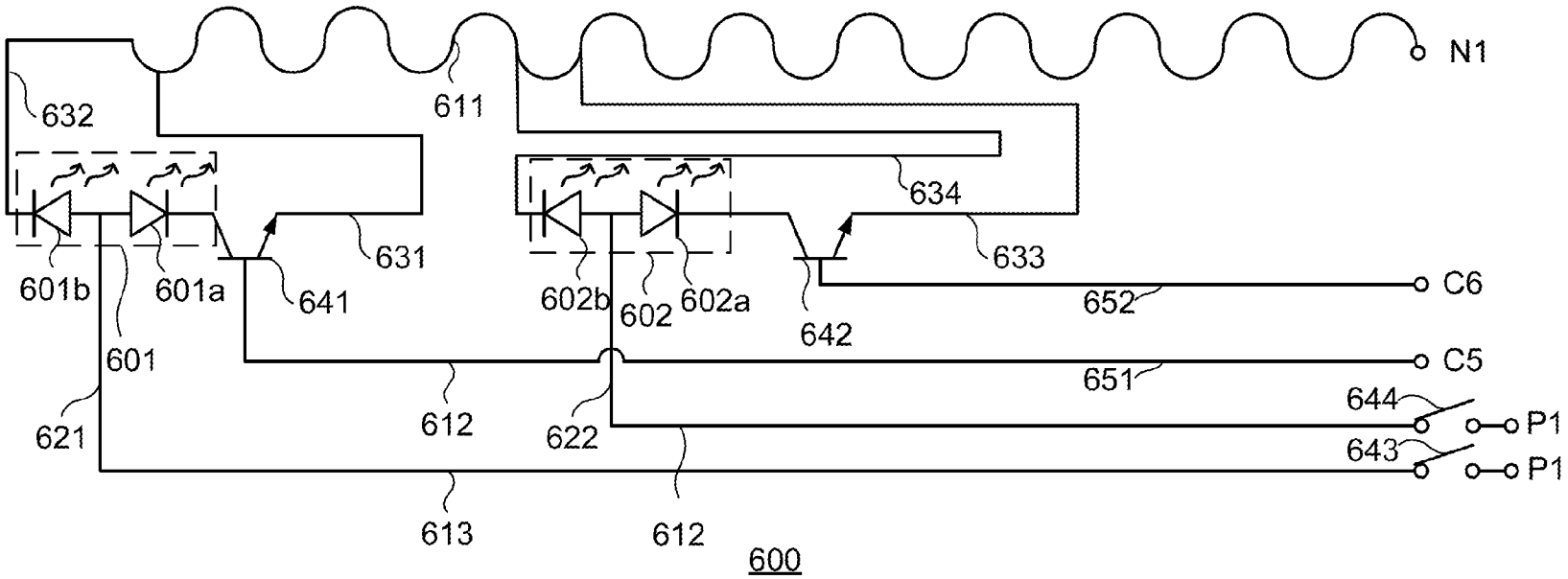
FIG. 6 depicts a schematic diagram of a circuit of light-emitting elements according to yet another embodiment of this disclosure.
Figure 7:
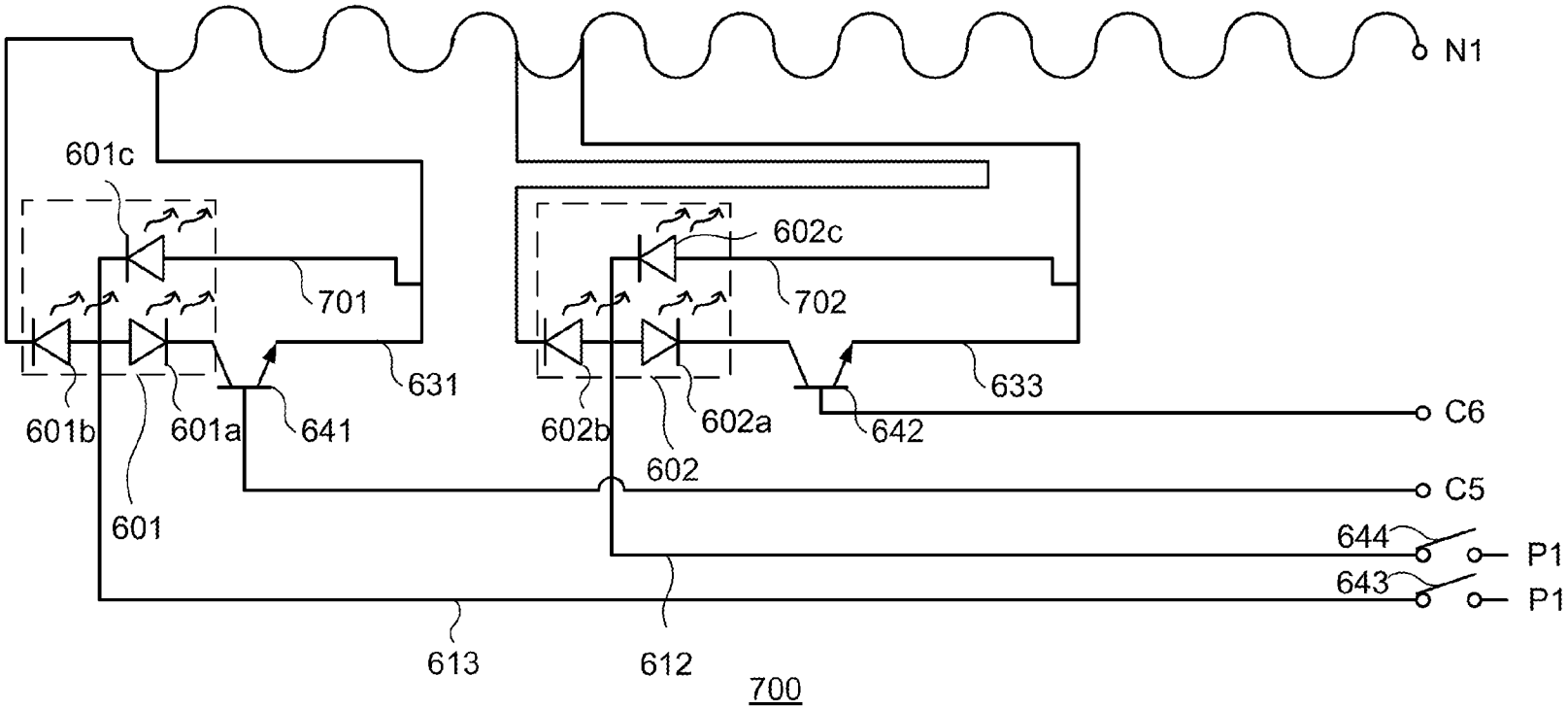
FIG. 7 depicts a schematic diagram of a circuit of light-emitting elements according to another embodiment of this disclosure

Referring to FIG. 6 and FIG. 7 simultaneously. FIG. 6 depicts a schematic diagram of a circuit of light-emitting elements 600 according to yet another embodiment of this disclosure. The circuit 600 is electrically connected between the power terminal P1 and the power terminal N1. The circuit 600 comprises a plurality of light-emitting element sets 601-602, a zigzag conducting line 611, a plurality of smooth conducting lines 612-613, a plurality of first connecting line segments 621-622, a plurality of second connecting line segments 631 and 633, a plurality of third connecting line segments 632 and 634, a plurality of switching elements 641-642, and a plurality of control lines 651-652. External switches 643-644 are connected between the power terminal P1 and the circuit 600.

The light-emitting element set 601 comprises a first light-emitting element 601*a* and a second light-emitting element 601*b*. The first and second light-emitting elements 601*a*, 601*b* are electrically connected in parallel to the smooth conducting line 613. The first and second light-emitting elements 601*a*, 601*b* are electrically connected at different positions of the zigzag conducting line 611. The light-emitting element set 602 comprises a first light-emitting element 602*a* and a second light-emitting element 602*b*. The first and second light-emitting elements 602*a*, 602*b* are electrically connected in parallel to the smooth conducting line 612. The first and second light-emitting elements 602*a*, 602*b* are electrically connected at different positions of the zigzag conducting line 611.

In the present embodiment, the switching element 641 is connected in series between the first light-emitting element 601*a* and the zigzag conducting line 611, and the switching element 642 is connected in series between the first light emitting element 602*a* and the zigzag conducting line 611. In some embodiments, the switching element 641 may be connected in series between the second light-emitting element 601*b* and the zigzag conducting line 611, and the switching element 642 is connected in series between the second light emitting element 602*b* and the zigzag conducting line 611.

The first connecting line segment 621 is configured for electrically connecting the first light-emitting element 601*a* and the second light-emitting element 601*b* to the smooth conducting line 613. The first connecting line segment 622 is configured for electrically connecting the first light-emitting element 602*a* and the second light-emitting element 602*b* to the smooth conducting line 612.

The second connecting line segment 631 is configured for electrically connecting the switching element 641 to the zigzag conducting line 611. The second connecting line segment 633 is configured for electrically connecting the switching element 642 to the zigzag conducting line 611.

The third connecting line segment 632 is configured for electrically connecting the second light-emitting element 601*b* to the zigzag conducting line 611. The third connecting line segment 634 is configured for electrically connecting the second light-emitting element 602*b* to the zigzag conducting line 611.

It is worth to note that the second and third connecting line segments 631, 633, 632, 634 are respectively configured for adjusting the shortest paths passing through the first and second light-emitting elements 601*a*, 602*a*, 601*b*, 602*b* to have substantially the same length. As a result, the shortest paths passing through the light-emitting elements 601*a*, 602*a*, 601*b*, 602*b* have substantially the same resistance value.

In some embodiments, the second connecting line segments 631, 633 and the third connecting line segments 632, 634 are respectively configured for adjusting conducting line widths, conducting line shapes, or conducting line densities thereof so that the shortest paths passing through the light-emitting elements 601*a*, 602*a*, 601*b*, 602*b* have substantially the same resistance value.

In some embodiments, the second connecting line segments 631, 633 and the third connecting line segments 632, 634 may be electrically connected to starting ends of different zigzag segments of the zigzag conducting line 611, so that the shortest paths passing through the light-emitting elements 601*a*, 602*a*, 601*b*, 602*b* have substantially the same resistance value.

The switching element 641 is configured for controlling conducting states of the first light-emitting elements 601*a*. The switching element 642 is configured for controlling conducting states of the first light-emitting elements 602*a*.

The external switches 634, 644 are configured for determining whether the smooth conducting line 613, 612 are electrically connected to the power terminal P1 so as to control conducting states of the first light-emitting element 601*a*, the second light-emitting element 601*b*, the first light-emitting element 602*a*, and the second light-emitting element 602*b*.

The control line 651 is configured for receiving a control signal C5. The control line 652 is configured for receiving a control signal C6. The control signals C5, C6 are respectively configured for controlling conducting states of the switching elements 641-642 so as to regulate conducting states of the first light-emitting elements 601*a*, 602*a*.

As to the driving method, the control signals C5, C6 and the external switches 643-644 are configured for controlling conducting states of the light-emitting element sets 601-602. Take the light-emitting element set 601 for example, when the control signal C5 has an enabling signal and the external switch 643 is turned on, the two light-emitting elements 601*a*-601*b* in the light-emitting element set 601 are simultaneously turned on. When the control signal C5 has a disabling signal and the external switch 643 is turned on, the light-emitting element 601*b* in the light-emitting element set 601 is turned on alone. When the control signal C5 has the disabling signal and the external switch 643 is turned off, none of the light-emitting elements 601*a*-601*b* in the light-emitting element set 601 will be turned on. The driving method of the light-emitting element set 602 is similar to the driving method of the light-emitting element set 601.

In summary, each current path in the circuit 600 has substantially the same resistance value so as to allow each of the light-emitting elements 601*a*, 601*b*, 602*a*, 602*b* has roughly the same luminance. In addition, since the external switches 643, 644 usually locate on one side of a circuit board or are implemented in an external driving circuit (such as a driver IC chip), the number of the switching elements in the circuit 600 won't be increased. Hence, the proportion of the light-emitting elements 601*a*, 601*b*, 602*a*, 602*b* to the switching elements 641, 642 becomes 2:1. As therefore, wire connection in the circuit 600 shall not be complicated due to excessive switching elements.

FIG. 7 depicts a schematic diagram of a circuit of light-emitting elements 700 according to another embodiment of this disclosure. As compared with the circuit 600 in FIG. 6, the light-emitting element sets 601/602 of the circuit 700 further comprises a third light-emitting element 601*c*/602*c*. The circuit 700 further comprises a plurality of fourth connecting line segments 701, 702. In the present embodiment, neither the power terminal P1 nor the power terminal N1 has a fixed voltage.

The third light-emitting element 601*c*, the first light-emitting element 601*a*, and the second light-emitting element 601*b* are electrically connected in parallel to the smooth conducting line 613. The third light-emitting element 602*c*, the first light-emitting element 602*a* and the second light-emitting element 602*b* are electrically connected in parallel to the smooth conducting line 612.

The fourth connecting line segments 701, 702 are respectively configured for electrically connecting the third light-emitting elements 601*c*, 602*c* to the second connecting line segments 631, 633.

As to the driving method, the control signals C5, C6, the external switches 643-644, and the power terminals P1, N1 are respectively configured for controlling conducting states of the light-emitting element sets 601-602. Take the light-emitting element set 601 for example, when the power terminal P1 has a high voltage and the power terminal N1 has a low voltage, the driving method for the first and second light-emitting elements 601*a*, 601*b* in the circuit 700 is similar to that for the first and second light-emitting elements 601*a*, 601*b* in the circuit 600 of FIG. 6. Additionally, when the power terminal P1 has a low voltage, the power terminal N1 has a high voltage, and the external switch 643 is turned on, the third light-emitting element 610*c* would be turned on.

Hence, in the circuit 700, the proportion of the light-emitting elements 601*a*, 601*b*, 601*c*, 602*a*, 602*b*, 602*c* to the switching elements 641, 642 becomes 3:1. In other words, the circuit 700 reduces the number of switching elements corresponding to each light-emitting element.

In all preceding embodiments, each of the switching elements may be a bipolar junction transistor (BJT).

In every forgoing embodiment, each the light-emitting element may be a light-emitting diode.

In terms of prior embodiments, applying the disclosed circuit of light-emitting elements not only makes the shortest path corresponding to each light-emitting element have substantially the same resistance value, but also effectively diminishes design complexity and power consumption of the external driving circuit. In addition, the number of switching elements utilized in the circuit of light-emitting elements is effectively reduced. Consequently, the objective of local dimming is achieved and the contrast ratio of the display device is efficiently enhanced. The present disclosure can further narrow the width of the light bar in the backlight module so as to get the result of thinning the backlight module.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A circuit of light-emitting elements connected between two power terminals, comprising:

a smooth conducting line connected to one of the power terminals;

a plurality of light-emitting elements, one terminal of each light-emitting element being electrically connected at a different position of the smooth conducting line;

a zigzag conducting line connected to the other of the power terminals, the other terminal of each light-emitting element being electrically connected at a different position of the zigzag conducting line;

a plurality of first connecting line segments; and a plurality of second connecting the first connecting line segments having a same resistance value, the second connecting line segments having different resistance values;

wherein each shortest path starting from one of the power terminals, passing through any of the light-emitting elements along the smooth conducting line, and ending at the other of the power terminals along the zigzag conducting line has substantially a same resistance value.

2. The circuit of light-emitting elements of claim 1, further comprising a plurality of switching elements respectively connected between the light-emitting elements and the smooth conducting line or the zigzag conducting line.

3. The circuit of light-emitting elements of claim 1 wherein the light-emitting elements are electrically connected at the different positions of the smooth conducting line respectively via the first connecting line segments, and the light-emitting elements being electrically connected at the different positions of the zigzag conducting line respectively via the second connecting line segments.

4. The circuit of light-emitting elements of claim 3, further comprising a plurality of switching elements respectively connected between the light-emitting elements and the first connecting line segments or the second connecting line segments.

5. The circuit of light-emitting elements of claim 1, wherein the zigzag conducting line has a plurality of zigzag segments, the light-emitting elements are respectively in electrical connection with starting ends of the zigzag segments.

6. The circuit of light-emitting elements of claim 5, wherein the zigzag segments have different resistance values, different conducting line lengths, different conducting line widths, different conducting line densities, or different shapes.

* * * * *